United States Patent [19]

Eguchi et al.

[11] 4,168,190

[45] Sep. 18, 1979

[54] METHOD FOR LOCALLY SOLUTION-TREATING STAINLESS MATERIAL

[75] Inventors: Toshiyuki Eguchi; Yoshihiro Imoto, both of Yokohama; Kouji Kurose, Kawasaki; Masanori Terasaki, Yokohama, all of Japan

[73] Assignee: Daiichi Koshuha Kogyo Kabushiki Kaisha, Tokyo, Japan

[21] Appl. No.: 791,213

[22] Filed: Apr. 27, 1977

[30] Foreign Application Priority Data

Apr. 27, 1976 [JP] Japan ..... 51-47267
Mar. 29, 1977 [JP] Japan ..... 52-33943

[51] Int. Cl.[2] ..... C21D 6/00

[52] U.S. Cl. ..... 148/136; 148/12 E; 148/127; 148/154

[58] Field of Search ..... 148/136, 127, 154, 12 E

[56] References Cited

U.S. PATENT DOCUMENTS 2,246,445 6/1941 Kiefer ..... 148/136
2,888,373 5/1959 Cherrie et al. ..... 148/136

*Primary Examiner*—R. Dean
*Attorney, Agent, or Firm*—Burns, Doane, Swecker & Mathis

[57] ABSTRACT

A method and apparatus for treating stainless steel material to reduce the carbon precipitation of the grain boundaries of the material as a result of temperature elevation due to welding, mechanical bending, or the like. The treatment includes the rapid heating of the material to the temperature at which the carbon will enter into solid solution followed by a rapid quenching of the heated material. Beneficial stress modifications are also achieved.

6 Claims, 24 Drawing Figures

METHOD FOR LOCALLY SOLUTION-TREATING STAINLESS MATERIAL

BACKGROUND OF THE INVENTION

The present invention relates to a novel solution treatment method by which the disappearance of the sensitized structure produced at part of the steel pipe, wire stock, plate stock, or material of arbitrarily-shaped cross section (hereinafter called "stainless material" for the sake of simplicity) which is formed of an austenitic alloy such as austenitic stainless steel by the thermal effect of heating or working accompanied by a rise in temperature at the time of subjecting partially said stainless material to said heating or said working accompanied by a rise in temperature, for example, welding or bending, can be achieved without newly forming the sensitized structure. Stainless material is excellent in corrosion resistance and mechanical properties, and stainless steel pipes, etc., are now widely used in a wide variety of equipment and installations such as nuclear reactors and chemical plants in a corrosive environment.

In building the above-mentioned nuclear reactor equipment or chemical plant, stainless material is often assembled into a part or incorporated into the mainbody of equipment in a factory or in a job site while being subjected to heating and working accompanied by a rise in temperature (such as hot bending or welding) at part of said stainless material. It is a phenomenon that carbide often precipitates on the grain boundaries within the structure of thermal boundaries between the places which have been subjected to said heating or working accompanied by a rise in temperature and the places which have not been subjected to said workings. This sensitized phenomenon results when the structure of the material, i.e. the material existing between the places which have been subjected to heating or working accompanied by a rise in temperature and the places which have not been subjected to said workings, is put in the range of temperatures of about 400° C. to about 800° C. (the socalled "a sensitizing temperature region") in the course of partially subjecting stainless material to heating or working accompanied by a rise in temperature. It is known that when liquid, gas, etc., containing corrosive substances, for example, such halogen ions as $Cl^-$, etc., or dissolved oxygen come into contact with the stainless material of which structure has been thus partially sensitized, the stainless material will corrode electrochemically.

In addition, it is known that when partially subjecting the stainless material to the above-described heating or working accompanied by a rise in temperature, tensile stresses may remain in the material and the residual stresses may act on the abovestated electrochemically-corroded portions to cause stress-corrosion cracking.

For example, in a case where the above-described stainless material is a pipe, the liquid passing into the pipe after the pipe is incorporated into the mainbody of a nuclear reactor equipment by welding may contain corrosive substances. The stainless steel pipe is electrochemically corroded by the corrosive substances at the portions of sensitized structure formed in the neighborhood of weld of the pipe and, in addition, the residual tensile stresses produced by welding act on the corroded portions, so that said pipe is sometimes cracked by stress-corrosion, giving rise to a grave situation from the view point of operation or safety of the equipment.

That stainless material which has been subjected not only to the above-stated welding but also to hot bending operation or other workings including local heating work and working accompanied by a rise in temperature suffers such corrosion or stress-corrosion cracking is well known and strenuous efforts have been made to work out a countermeasure.

There are indications that the stainless material will profit from being subjected to solution-treatment (also called "solid-solution treatment") at the part of sensitized portions to avoid corrosion or stress-corrosion cracking at the portions which have been subjected to local heating or working accompanied by a rise in temperature. However, the ordinary method is that of raising the temperature of an article to be treated which has been locally sensitized to a temperature (approximately 1090° C., hereinafter the same temperature) at which carbide will enter into solid solution in a heating furnace followed by cooling the article, and since even the portions requiring no treatment will come to be subjected to the solution-treatment, it follows that this method is unreasonable and poor economy. In addition, it may be impossible for the large sized parts of the stainless material to be subjected, as a whole, to such a solution treatment as that described above.

Accordingly, as for the large sized parts of the stainless material, it has been a practice to subject only the portions which have been locally sensitized by a thermal effect during the preceding operation to the solution treatment in such an equipment as the above-mentioned heating furnace. However, when being subjected to the partial solution treatment in such a manner, the sensitized structure which has been produced during the preceding operation is transformed to another state in which carbide will enter into solid solution, but a new sensitized structure is produced at the thermal boundaries between the portions heated and the portions not-heated during the second solution treatment. In other words, this manner suffers the defect that the desired object cannot be eventually accomplished.

Additionally, for example, on giving consideration to the corroded or stress-corrosion cracked portions of the parts made of the stainless material and used in nuclear reactor equipment, even where the parts have been previously subjected to solution treatment, no effective method has been found since the sensitized structure is formed at thermal boundaries during the welding operation or high-temperature brazing operation in the assembling of said parts or in the incorporation of said parts into the main body of the equipment at the job site. Therefore, it is necessary to use the parts as sensitized and this forms the main cause of occurrence of the corrosion or stress-corrosion cracking.

The present invention has been made with the object of providing a method for localized treating of stainless material sensitized as stated above at the thermal boundaries of the stainless material during the incorporation of said material into the main body of such an equipment as nuclear reactor equipment, chemical plant, or other equipment by subjecting the material to a working such as local hot-bending or welding operation in which the temperature of part of said material is raised to a high temperature by heating in a factory or in a job site in the fabrication of the nuclear reactor equipment, chemical plant, or other equipment. In the present invention, the carbide will enter into solid solution without exercising an ill effect upon other sound structure portions to such a degree that it may safely said that there is no said effect at all even in a case where said material is an independent part or even after said material has been incorporated into the main body.

The constitution of the present invention is chiefly characterized by rapidly heating the material of which structure has been partially sensitized, as in the neighborhood of weld of said material, by heating or working accompanied by a rise in temperature, either at the sensitized structure portions alone or at neighboring portions to a temperature at which carbide will enter solid solution, followed by rapidly quenching the material within a treating time allowed according to the carbon content of said material.

THE DRAWINGS

Figure 1:
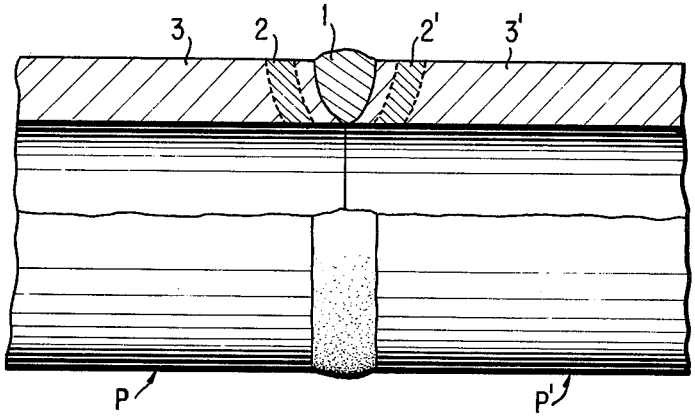
FIG. 1 is an elevation in partial section of a test piece which structure has been partially sensitized.
Figure 3B:
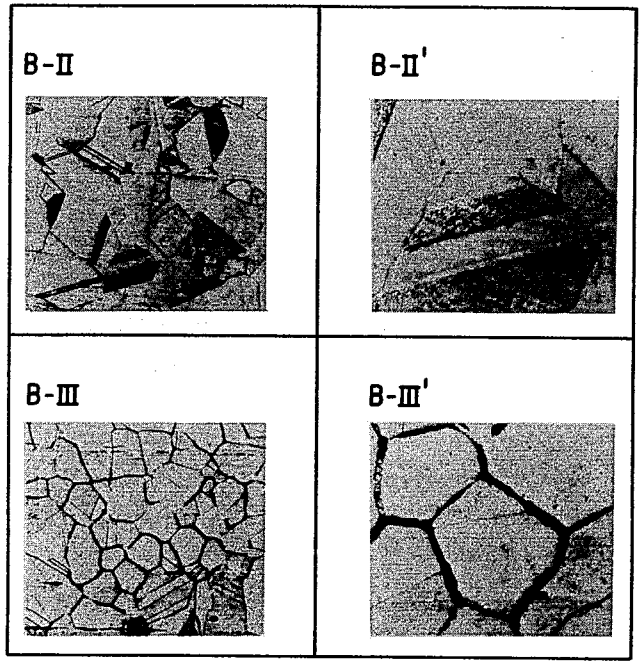
Figure 3A:
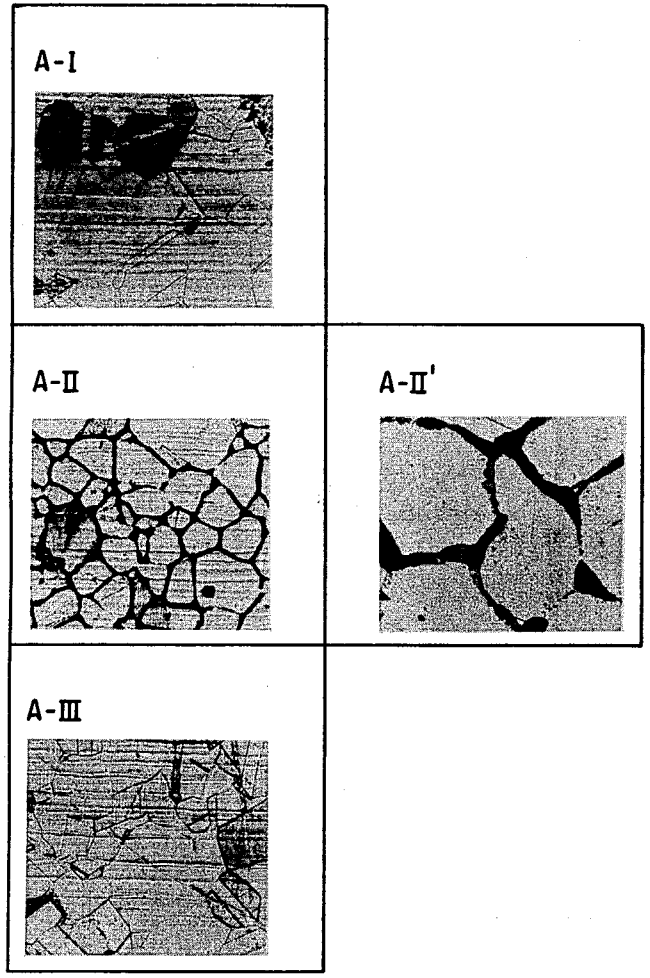
Figure 3D:
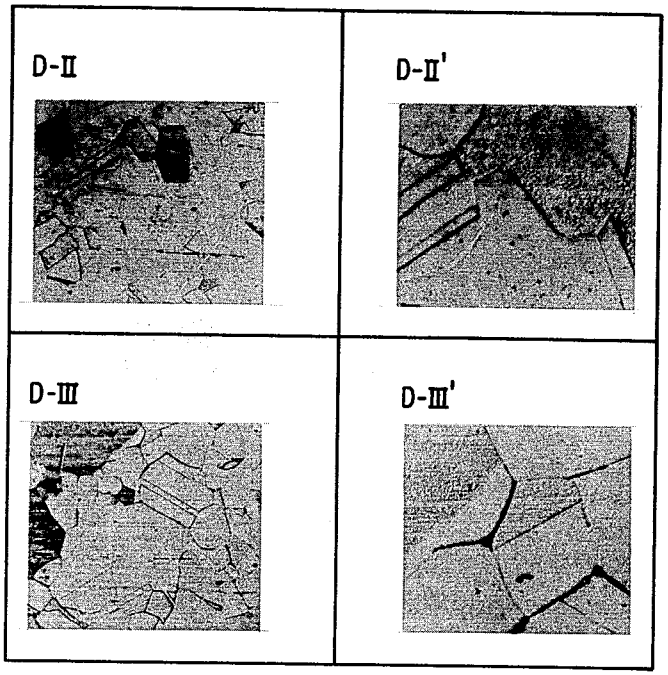
Figure 3C:
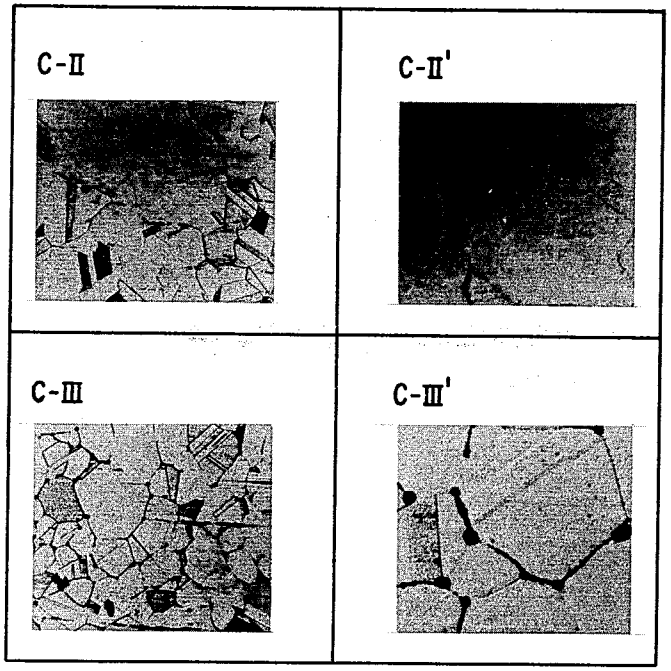
Figure 4F:
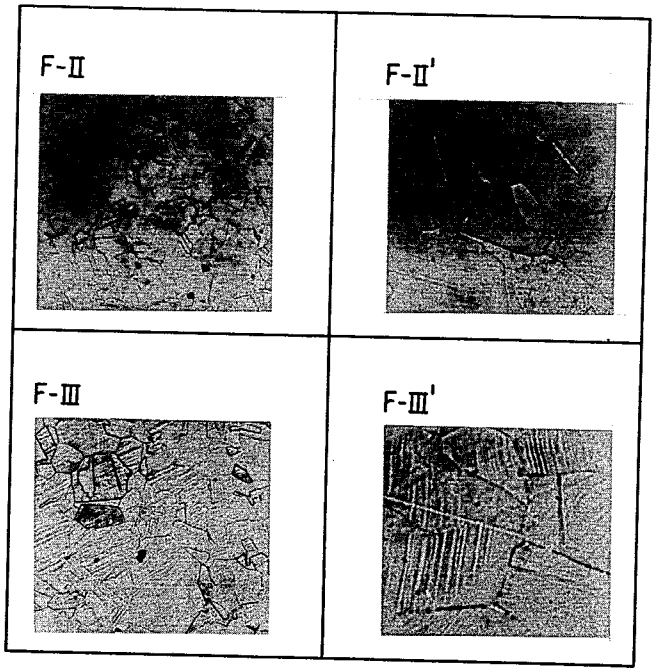
Figure 4E:
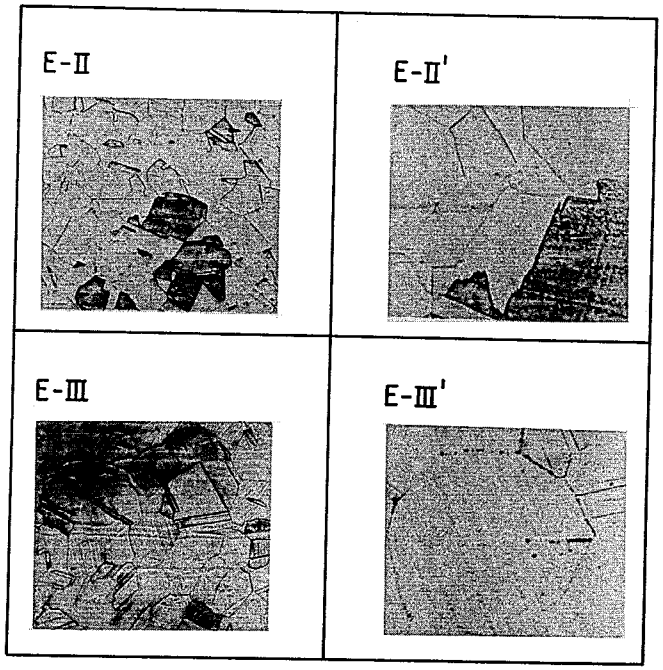
Figure 4H:
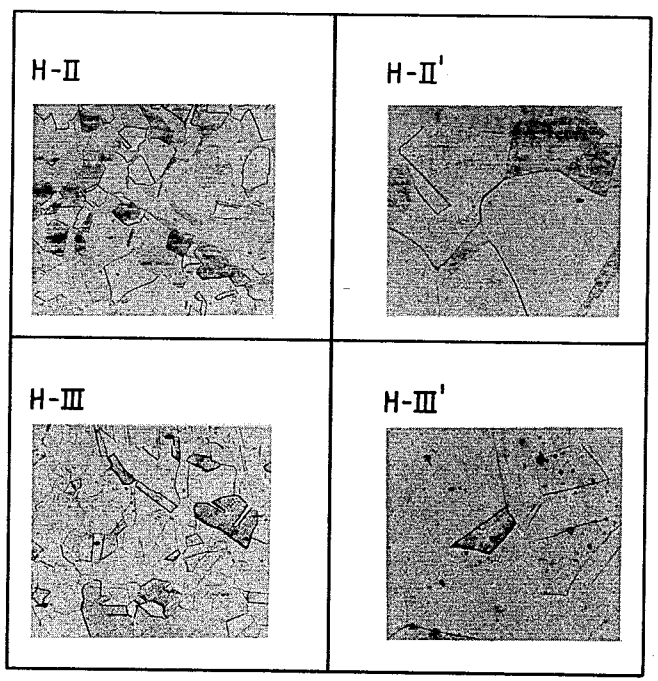
Figure 4G:
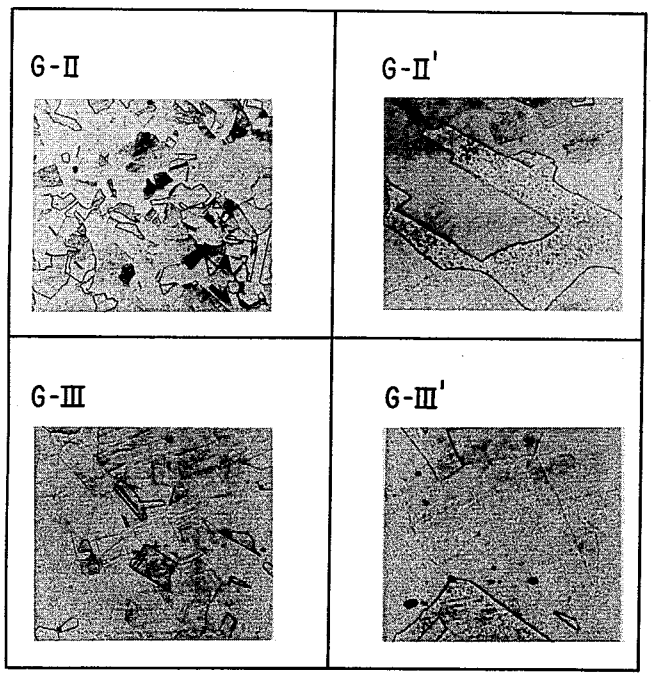
Figure 5A:
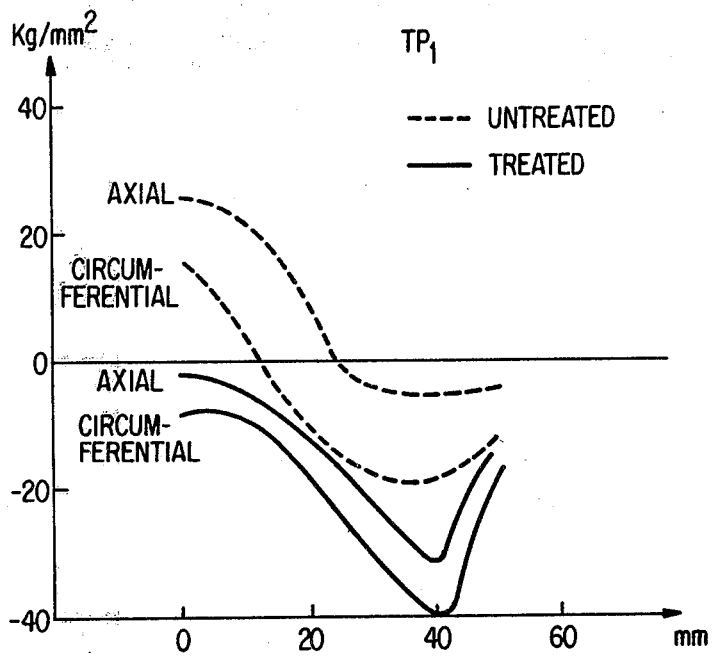
Figure 5B:
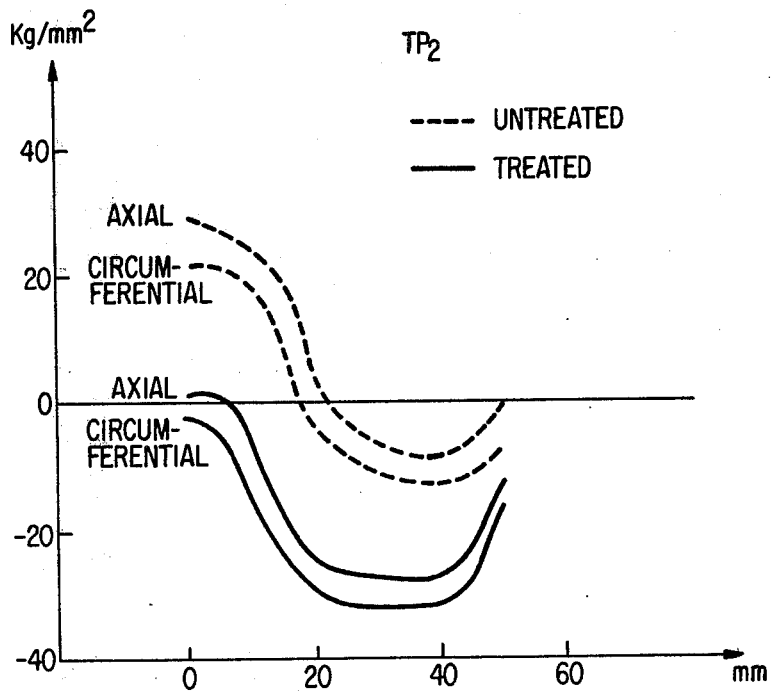

FIG. 3A (FIGS. A-I, A-II, A-II' and A-III) are magnified photographs of structures of each portion of the test piece shown in FIG. 1;

FIG. 3B (FIGS. B-II, B-II', B-III and B-III') are magnified photographs illustrating the results of a first example of the present invention on a test piece of low carbon content;

FIG. 3C (FIGS. C-II, C-II', C-III and C-III') are magnified photographs illustrating the results of a second example of the present invention on a test piece of low carbon content;

FIG. 3D (FIGS. D-II, D-II', D-III and D-III') are magnified photographs illustrating the results of a third example of the present invention on a test piece of low carbon content;

FIG. 4E (FIGS. E-II, E-II', E-III and E-III') are magnified photographs illustrating the results of a first example of the present invention on a test piece of high carbon content;

FIG. 4F (FIGS. F-II, F-II', F-III and F-III') are magnified photographs illustrating the results of a second example of the present invention on a test piece of high carbon content;

FIG. 4G (FIGS. G-II, G-II', G-III and G-III') are magnified photographs illustrating the results of a third example of the present invention on a test piece of high carbon content;

FIG. 4H (FIGS. H-II, H-II', H-III and H-III') are magnified photographs illustrating the results of a fourth example of the present invention on a test piece of high carbon content;

FIG. 5 are charts showing the distribution states of the axial or longitudinal residual stresses on the inner surfaces of the test pieces with dotted lines showing the range of residual stresses of the test pieces as welded and solid lines showing the range of residual stresses of the test pieces after being solution treated according to the method of the present invention.

Figure 6A:
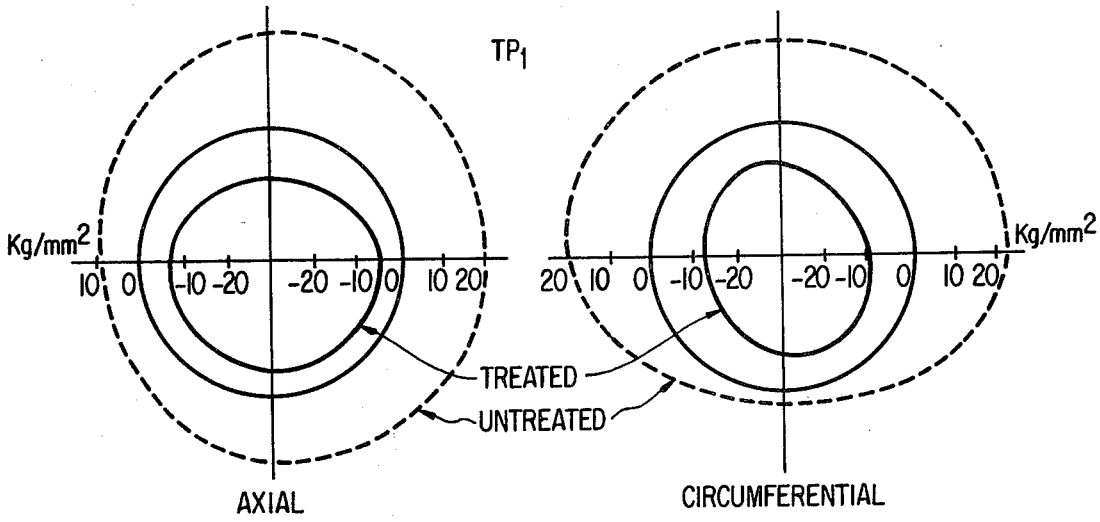
Figure 6B:
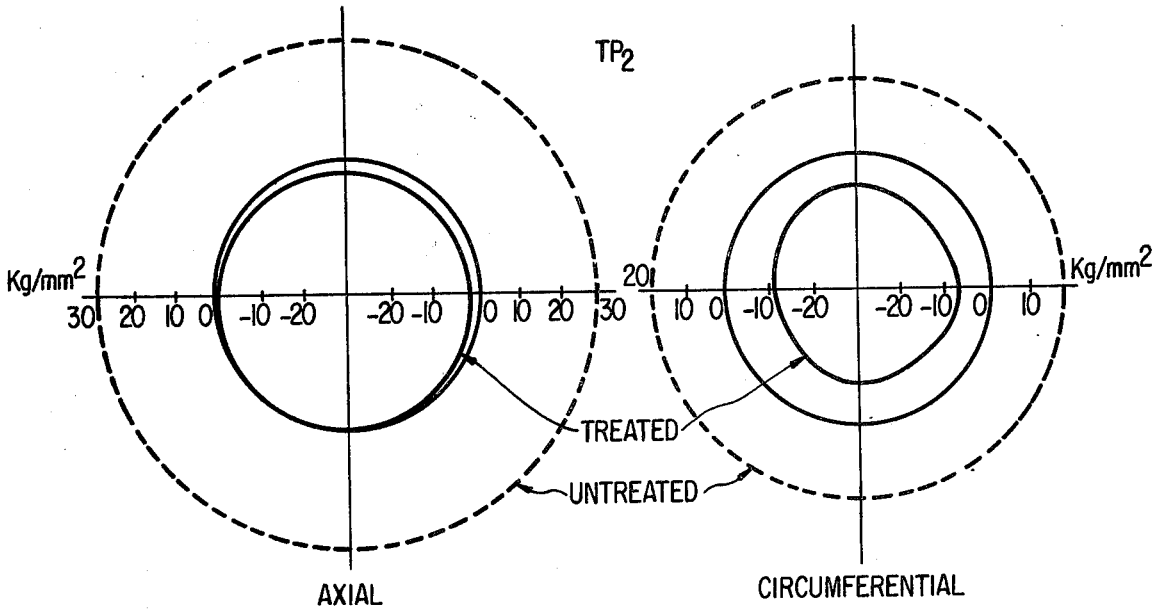

FIG. 6 are charts showing the distribution states of the circumferencial residual stress respectively on the inner surfaces on radial direction cross section of the test pieces, the lefthand figure taken through the bead and the righthand figure at a distance of 10 mm from the bead.

Figure 7:
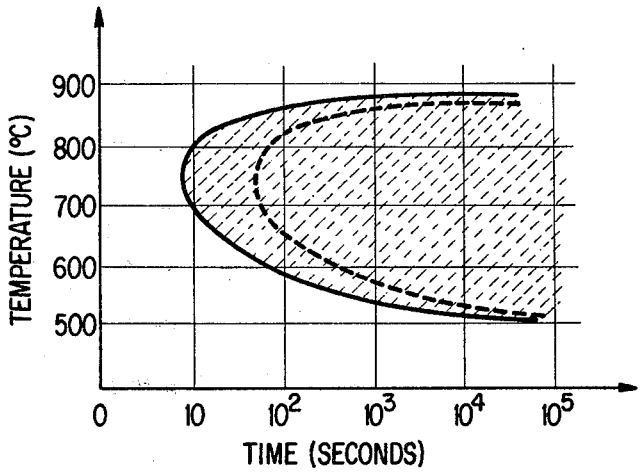
Figure 8:
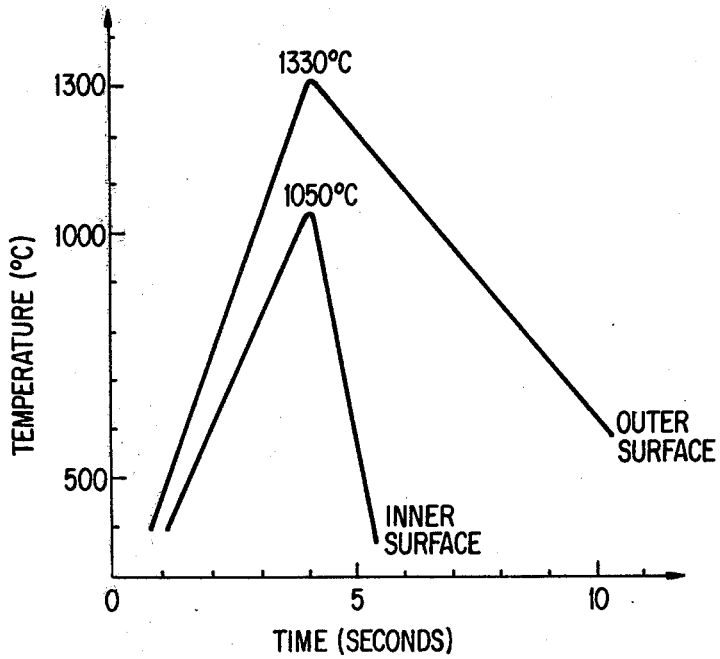

FIG. 7 is a chart showing the relationship between the temperature region in which the structure of the stainless material is sensitized and the time of heating;

FIG. 8 is a history chart of temperatures on the inner and outer surfaces of the thick stainless material in the case where the thick stainless material was solution treated according to the method of the invention without pre-heating.

Figure 9:
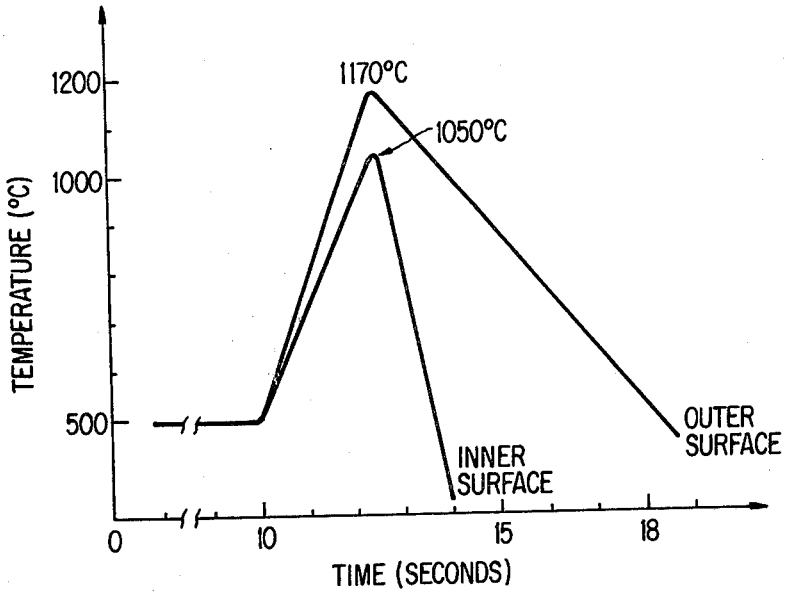

FIG. 9 is a history chart of temperatures on the inner and outer surfaces of thick stainless material in the case where the thick stainless material was solution treated after pre-heating.

Figure 10:
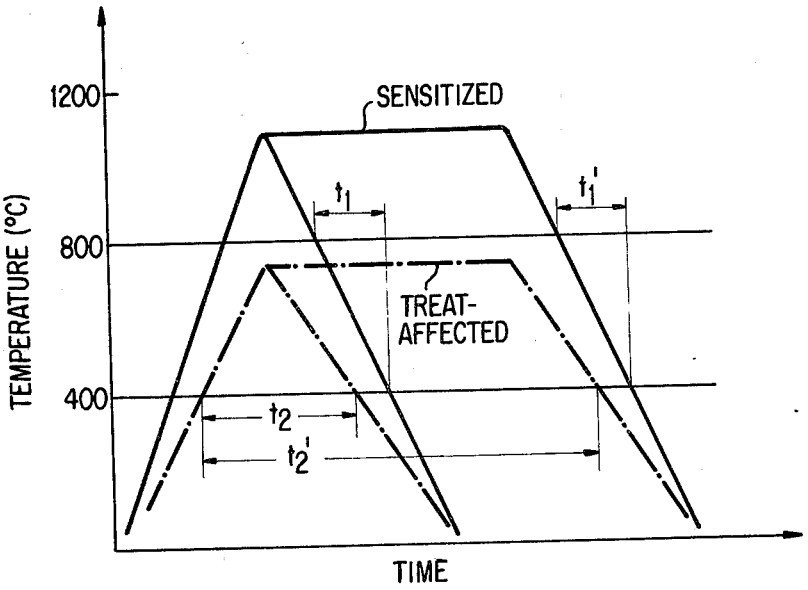

FIG. 10 is a chart showing the relationship between the time required for the treatment according to the method of the invention and the times during which the "sensitized portions" (solid line) and "treat-affected portions" (dotted line) of the test piece are put in the sensitizing temperature range.

Figure 11A:
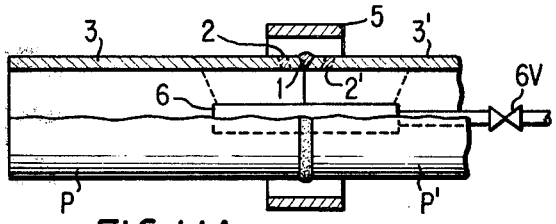
Figure 11B:
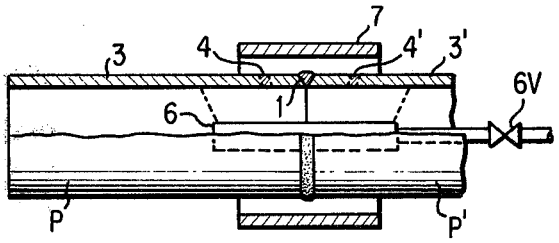
Figure 12A:
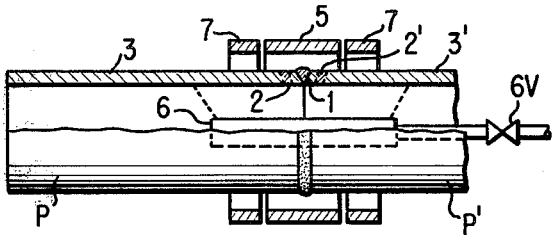
Figure 12B:
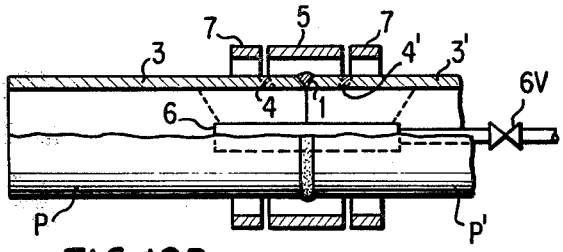

FIGS. 11 and 12 are longitudinal elevations in partial section illustrating apparatus for carrying out the post-treatment in the local solution treatment according to the method of the invention, FIGS. 11A and 12A showing heat treatment to improve the weld and FIGS. 11B and 12B showing heat treatment for the sensitized area.

Figure 13:
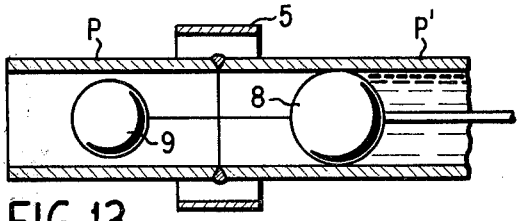
Figure 14:
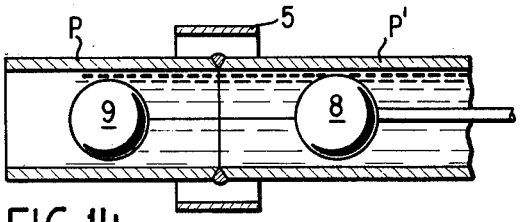

FIG. 13 is an elevation in axial sectional, showing another embodiment of a cooling means; and, FIG. 14 is an elevation in axial sectional illustrating the operation of the means of FIG. 13.

THE DETAILED DESCRIPTION

In FIG. 1, a piece which had been butt-welded out of the JIS SUS-304, Schedule 80 pipes as parent metals was used as the test piece. A bead weld and the portions 2 and 2' of the structure have been sensitized by a temperature rise due to heating during weld operation, portions 3 and 3' which have not received at all a thermal effect during the weld operation are sound.

A great number of two kinds and of the test pieces as described above, were prepared by welding them out of the stainless pipes of 0.06% in carbon content, 88.9 mm in outer diameter, and 7.6 mm in wall thickness (hereinafter $TP_1$), and out of the stainless pipes of 0.03% in carbon content, 114.3 mm in outer diameter, and 8.6 mm in wall thickness ($TP_2$). The results as stated below were obtained from the observations of the cross sections of structure and from the measurements of the residual stresses of the pipes.

The photographs of FIG. 3A show the states of structure of the welded but untreated Test Piece ($TP_1$). At a magnification of 100X, photograph (A-I) shows the portions of the boundaries (hereinafter called "bead boundaries portions") between the bead weld 1 and the parent metals P and P' in FIG. 1, photograph (A-II) shows the portions (hereinafter called "sensitized portions") in which structure has been sensitized by receiving a thermal effect during the weld operation in FIG. 1, and photograph (A-III) shows the portions (hereinafter called "sound structure portions") which has not received at all the thermal effect during the weld operation.

The examination of these photographs showed that carbide appeared black at grain boundaries of only the "sensitized portions" shown in photograph A-II as a result of precipitation of the carbide at said boundaries of only said "portions" similarly to a phenomenon which is known heretofore with regard to the weld of stainless material. The structure of these portions had been sensitized (refer also the Photograph A-II' of these portions taken at a magnification of 400X), and the structure at the boundaries ("bead boundaries' portions") between the bead weld 1 and the parent metals P and P' had not been sensitized.

Since the results of examination on each structure of the welded Test Pieces $TP_2$ were roughly the same as those on each structure of the welded Test Pieces $TP_1$, the representation of the photographs of the Test Pieces $TP_2$ is omitted.

On the other hand, from the measurements of the axial and circumferential tensile stresses which had been produced by heating during the weld operation on the inner surface of the neighborhood of the weld of the Test Pieces $TP_2$, it was found that residual tensile stresses were present in the states of distribution as indicated by the dotted lines in FIGS. 5 and 6.

Figure 2:
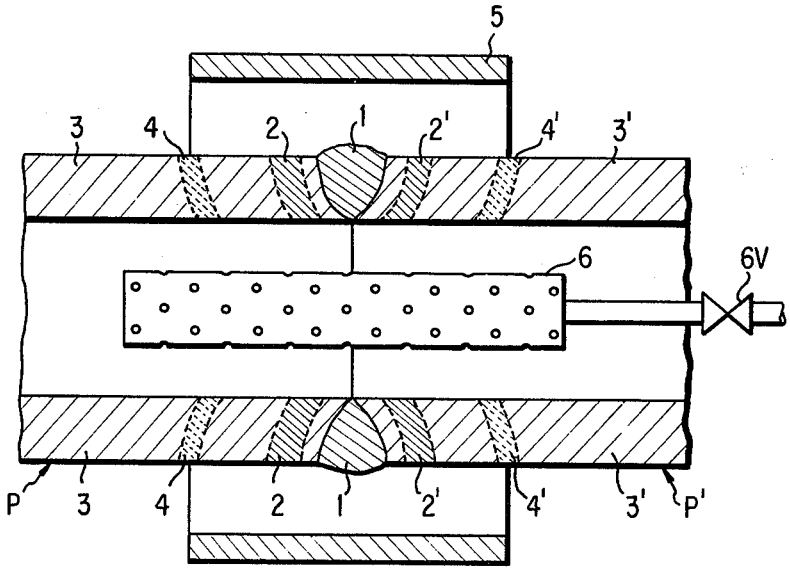
FIG. 2 is an elevation in axial section showing an example of states of solution treating the test piece of FIG. 1, according to the method of the invention.

Accordingly, after each of the Test Pieces $TP_1$ which had the structure which had been locally sensitized as shown in FIG. 1 by receiving the thermal effect during the welding operation was subjected to the solution treatment method of this invention shown in FIG. 2 and was cut along a plane containing the axis, observations were made on the states of each of those structures appearing on axial sections among which are included the "bead boundaries' portions" I, the "sensitized portions" II, and the portions III which would come into thermal boundaries (hereinafter called "treat-affected portions") during the solution treatments. As a result of the treatment, no change appeared at the "bead boundaries' portions", but such changes as will be described below appeared at the "sensitized portions" and "treat-affected portions".

With reference to FIG. 2, the sensitized structure 4 and 4' at the "treat-affected portions", inductor 5 for heating, a cooling liquid nozzle 6, and a valve 6V are illustrated.

EXAMPLE B

In photographs B appearing in FIG. 3, photographs B-II through B-III', respectively, show the structure of the above-mentioned "sensitized portions" (B-II) and "treat-affected portions" (B-III) of one Test Piece $TP_1$ of which the temperature was elevated by a induction heating of 50 kw within the range of 100 mm of the weld of the test piece over a period of 16 seconds to a temperature at which carbide would enter into solid solution, immediately followed by rapidly quenching the test piece by allowing water to flow into the test piece pipe. The carbide at grain boundaries as perceived in photograph A-II presented previously has almost disappeared from the "sensitized portions" shown in these photographs B-II, B-II' and B-III.

However, from the fact that the carbide which had not been perceived at all before the solution treatment has precipitated at grain boundaries of the "treat'affected portions" it may be safely said that the tendency of sensitization have appeared clearly at said portions. But then the tendency of sensitization of these portions is less than that of the "sensitized portions" (shown in photograph A-II') which has been formed by the welding operation. This can be confirmed by comparing the photograph A-II' with the photograph B-III', each photograph being taken at a higher magnification.

It can be seen from these photographs that when a local solution treatment is carried out in order to cause the sensitized structure produced by welding operation to disappear, the portions 4 and 4' may be sensitized within the portions 3 and 3' of the structure which had theretofore been sound.

EXAMPLE C

In the photographs (C's) appearing in FIG. 3, photographs C-II through C-III', respectively, show the structures of the above-described portions II and III in one further other Test Piece $TP_1$ of which the temperature was elevated by an induction heating of 160 kw in the neighborhood of the weld of said Test Piece $TP_1$ within the range similar to that of the Test Piece $TP_1$, from which the photographs of FIG. 3B were taken, in about 6 seconds to a temperature at which carbide will enter into solid solution, immediately followed by rapidly quenching the Test Piece $TP_1$ by allowing water to flow into the test piece pipe.

As shown in the figures the carbide which had precipitated at grain boundaries has nearly completely disappeared from the "sensitized portions" shown in the photograph C-II. Besides, the degree of precipitation of carbide in the "treat-affected portions" shown in the photograph C-II has appeared lower than that in the photograph B-III. This can be confirmed by comparing the photographs B-III' with C-III', each photograph being taken at a higher magnification. It may be judged from these that when the heating time required for the temperature to reach a temperature at which carbide will enter into solid solution is shorter, better results can be obtained from the viewpoint of prevention of sensitization.

EXAMPLE D

In FIG. 3, photographs D-II through D-III' show the structures of the above-described portions II and III in one still further other Test Piece $TP_1$ of which the temperature was elevated by an induction heating of 400 kw to a temperature at which carbide would enter into solid solution, immediately followed by rapidly quenching the test piece in the same manner as that of the above-mentioned two examples. In this case, it took only 2 seconds for the temperature of the test piece to reach a temperature at which carbide would enter into solid solution.

As shown in the photographs, the carbide which had precipitated in the "sensitized portions" has completely disappeared from the photographs D-II and D-II' as was in the case of the photographs B-II, B-II', C-II, and C-II' of the above examples. Moreover, only the precipitation of an expremely small amount of carbide has been perceived in photographs D-II and D-II'. This can be confirmed by comparing the photographs B-III', C-III' and D-III' of the "treat-affected portions" in the examples with each other, each photograph having been taken through a microscope of a higher magnification.

Next, when Test Pieces $TP_2$'s which were different from Test Pieces $TP_1$'s in carbon content (i.e. having a carbon content respectively of 0.06% and 0.03%) were subjected to local solution treatments under a variety of the conditions based upon the method of this invention shown in FIG. 2 in the same manners as those in the case of the Test Pieces $TP_1$'s, the results as shown in photographs (E's) and (H's) in FIG. 4 were obtained on the "sensitized portions" II and "treat-affected portions" III of each of the Test Pieces $TP_2$'s, the photographs E-II, E-III, H-II and H-III being taken through a microscope of 100 magnification, and the photographs E-II', E-III', H-II and H-III' being through a microscope of 400 magnification.

Since the Test Piece $TP_2$'s have not suffered any change at the "bead boundaries" I of the Test Piece $TP_2$'s, these photographs have been omitted.

EXAMPLE E

The photographs (E's) show the structures, under magnification, of the portions II and III in one of the Test Pieces ($TP_2$'s of which the temperature was elevated by an induction heating of 70 kw within the range of 100 mm of the weld of the test piece to a temperature at which carbide would enter into solid solution over a period of about 60 seconds, immediately followed by quenching the test piece by allowing water to flow into the test piece. The carbide which had precipitated at grain boundaries has nearly completely disappeared from the "sensitized portions" shown in the photograph E-II, whereas a slight amount of carbide has been perceived in the "treataffected portions" shown in photograph E-III. This can be confirmed by the photographs E-II' and E-III' of the two "portions" at higher magnification.

EXAMPLE F

Photographs (F's) in FIG. 4 show the structures, under magnification, of the portions II and III in one other Test Piece $TP_2$ which was subjected, in the same manner as that in the preceding example, to a local solution treatment by raising the temperature of the test piece by the use of an induction heating of 100 kw, in the case of which it took about 30 seconds for the temperature of the test piece to reach a temperature at which the carbide would enter into solid solution. The carbide which had precipitated during welding operation has nearly completely disappeared, as has been the case with the test piece shown in the photographs (E's), from the "sensitized portions" shown in photograph F-II, but an extremely slight amount of the carbide has been perceived in the "treat-affected portions". This can be confirmed by the photographs F-II' and F-III' of the two "portions" under higher magnification.

EXAMPLE H

The photographs (H's) in FIG. 4 show the structure, under magnification, of the portions II and III in one further other Test Piece $TP_2$ which was subjected, in the same manner as that in the preceding examples, to the local solution treatment by raising the temperature of the test piece by the use of an induction heating of 600 kw, in the cases of which it took only about 4 seconds for the temperature of the test piece to reach a temperature at which the carbide would enter into solid solution. The precipitation of the carbide was not perceived at all both The precipitation of the carbide was not perceived at all both in the "sensitized portions" shown in photograph H-II and in the "treat-affected portions" shown in photograph H-III. This can be confirmed by photographs H-II' and H-III' of the two "portions" under higher magnification.

The following has been revealed as a result of carrying out the method of the present invention on the above-mentioned test pieces:

When the test pieces were partially heated in order that the test pieces might be subjected to local solution treatment, then in the "treat-affected portions", i.e. in the neighborhood of thermal boundaries between the zones (at which the temperature was elevated by the heating to a temperature at which carbide would enter into solid solution) and the zones (at which the temperature was not elevated by the heating, to the temperature at which the carbide would enter into solid solution), the structure of some of the test pieces was changed into the sensitized structure because the structure in the "treat-affected portions" was maintained at a sensitizing temperature region (from 400° to 800° C.). The sensitized structure observed in this "treat-affected portions" similarly to the sensitized structure produced in the "sensitized portions" in welding the test pieces out of pipes (refer to photograph A-II), was the structure which was sensitized concomitantly by the solution treatment (refer to photographs B-III and B-III').

It can be seen that this tendency to be sensitized either becomes weaker as the time required to heat the test pieces or to raise the temperature of the test pieces becomes shorter (refer to photographs C-III', D-III', E-III' and F-III'), or has not been exhibited at all (refer to photographs G-III' and H-III').

The test pieces in which a phenomenon of sensitization did not take place in the above-described "treat-affected portions" of the test pieces and which were rapidly heated by the induction heating of high output showed great differences in temperature between the inner surface $I_1$ of the test pieces and the outer surface $O_1$ thereof as shown in FIG. 8.

On referring to FIG. 8, when the inner-surface $I_1$ temperature of the zones to be treated of a test piece was elevated to a temperature (1050° C.) at which the carbide would enter into solid solution, the outer-surface $O_1$ temperature then reached a temperature as high as about 1330° C. Since this difference in temperature arises more remarkably with increasing the thickness of articles to be treated, fears are entertained of giving rise to melt-caused damage on the outer surface.

The results as shown in the photographs presented previously were obtained by subjecting each of the test pieces to rapid cooling by allowing water to gush from a cooling-liquid nozzle 6 toward the inner surface of the pipe after the temperature of each of the test pieces were raised to a temperature at which the carbon would enter into solid solution, whereas the other test pieces which were air-cooled over a period of approximately 60 seconds after the temperature of the test pieces was raised to the above mentioned temperature have been sensitized throughout nearly the whole of the heated or temperature-raised zones.

It has been found that the two kinds of test pieces, i.e. $TP_1$ and $TP_2$, which are different from one another in carbon content are different from one another in the time required to locally solution treat the test pieces to obtain nearly equal results. As shown in the photographs of each test piece stated previously, the Test Pieces $TP_2$ have produced better results as compared with the Test Pieces $TP_2$, even in a case where the time required to treat the Test Pieces $TP_2$ in accordance with the method of the present invention is somewhat longer.

With respect to the Test Pieces $TP_1$, however, the test pieces with a shorter treatment span have produced better results. As shown in FIG. 10, this suggests, from the relationship between the time T which the treatment by the method of the present invention requires and two spans $t_1$ and $t_2$ of the time during which the "sensitized portions" and "treat-affected portions" of each test piece are put in a region of temperature of sensitization in solution treatment, that the treatment which causes the two spans of time to be shorter is preferable, especially the time $t_2$ during which the "treat-affected portions" are put in the region of temperature of sensitization.

In FIG. 10, solid lines and dotted lines, respectively, show the states of temperature histories of the "sensitized portions" and "treat-affected portions" in the solution treatment by the method of this invention.

It has been recognized that residual tensile stresses are present on the inner surface of the weld of each welded but untreated test piece (refer to the portions shown by dotted lines in FIGS. 5 and 6 which illustrate the distribution state of residual stresses of the Test Piece $TP_2$), but, after the solution treatment following the method of this invention, such great residual tensile stresses as those set up before the treatment have not been present at the weld or in the neighborhood thereof as shown by the portions shown by solid lines in FIGS. 5 and 6.

It is thought that cooling the pipe by allowing water to flow into the pipe after heating or temperature raising is finished has resulted in the distributions of the stresses.

It may be said in this connection that, when one other test piece was heated or temperature raised under the conditions similar to those in the case of the above-mentioned test pieces, followed by water cooling of the test piece from the outside, a tensile stress of 30 $kg/mm^2$ then was present on the inner-wall surface of the pipe, i.e. said test piece.

As can be seen from the above-described results, it is preferable to embody industrially the method of the present invention in the embodiments as stated below:

In a case where the portion of which the stainless material's structure has been partially sensitized and the portions of sound structure coexist as a result of the material's being subjected to such partial heating or the workings accompanied by a rise in temperature in part of the material as welding or hot-bending, the following countermeasures should be taken inorder that the material may be subjected to the local solution treatment by which the portions of sound structure of said material will not be sensitized, but the locally sensitized structure alone can be transformed into another state where carbide will enter into solid-solution.

(1) A means of induction heating or a means of resistance heating should be adopted as a means which is capable of locally heating the material to elevate the temperature of the material, in a short period of time, to a temperature at which the carbide will enter into solid solution.

(2) In the case where articles to be treated are thicker, since heating rapidly the material for the purpose of raising the temperature of the inner surface to be heated to a temperature at which carbide will enter into solid solution can cause the grains of the outer surface being heated to coarsen or to suffer melt caused damage, the material should be subjected to pre-heat treatment in the embodiment as stated below:

It has been reported that sensitization of structure of stainless material is ascribed to the fact that the structure thereof is put in the sensitizing temperature region of 400° C. to 800° C. over a certain period of time (the portion bounded by the dotted line in FIG. 7), whereas the inventors of the present invention have found, as a result of a series of their experiments, that the sensitizing region is shown by the portion bounded by a solid line. This material will profit from the pre-heat-treatment under the conditions of temperature and time outside said sensitizing region. When the same test piece as had exhibited a great difference in temperature between the inner and outer wall-surfaces heated $I_1$ and $O_1$ as shown in FIG. 8 was subjected to pre-heat-treatment at about 500° C. for about 10 seconds as shown in FIG. 9, followed by being subjected to primary heat-treatment and the temperature of the inner wall-surface $O_2$ reached a temperature at which carbide enter into solid-solution, the temperature of the outer wall-surface $O_2$ was approximately 1170° C.; the difference in temperature between the inner and outer wall-surfaces was not so great as the test piece shown in FIG. 8.

(3) In a case where the object to be treated is the weld of which the weld metal is of character of acquiring sufficient, metallurgical and mechanical properties only when being subjected to heat-treatment at a higher temperature for a relatively long period of time, there should be carried out a treatment combining a heat treatment to improve the structure of the weld metal and a solution treatment for the "sensitized portions" caused by the previously-stated welding.

In this case, since it is necessary to heat the material to a high temperature for the purpose of improving the structure of the above-described weld metal and to maintain said temperature for some time, it follows that the "treat-affected portions" are maintained in the sensitizing-temperature region (refer to FIG. 10), promoting the sensitization of the "treat-affected portions". In order to cause the sensitized structure newly formed at that time to disappear, the treatment following the method of the present invention, as post-treatment, can be applied to only the portions of said sensitized structure. In other words, after the heat-treatment to improve the structure of the weld metal is conducted in the embodiment shown in FIG. 11 (a) or in FIG. 12 (a), the treatment following the method of the present invention, as the post-treatment, is applied to the portion of the structure which has been sensitized during the heat-treatment precedently applied. Additionally, FIGS. 11 and 12 use the same symbols to indicate the same parts with an inductor 7 shown for the post-treatment.

(4) In order that the material which has been heated to a temperature at which carbide will enter into solid solution may be rapidly cooled, there should be adopted a water cooling means or other proper rapid cooling means which permits the time during which the heated portions, particularly the "treat-affected portions" pass through the sensitizing-temperature region in the course of a drop in temperature to shorten satisfactorily.

(5) In a case where the above-mentioned pre-heating is not required, as for the time required for the local solution treatment according to the method of this invention, care should be taken so that the total of time which elapses between the beginning of heating and the end of cooling can be minimized, thereby shortening the time during which the "sensitized portions" are put in the sensitizing-temperature region to prevent the sensitization of the structure.

(6) Since, as can be seen from the results on each of the test pieces stated previously, the time required for the treatment stated in the preceding paragraph (5) varies with the content of the stainless material, this fact may be considered at the time of the treatment. That is to say, since, on comparing the previously-stated Test Piece $TP_1$ with the Test Piece $TP_2$, a desired effect was obtained even from the low-carbon-content Test Pieces $TP_2$ which had been subjected to the treatment in which the test pieces were heated by a relatively low heat source of relatively low output while allowing a period of some degree of time for elevating the temperature of said test pieces, it follows that, as for the low-carbon stainless material, the temperature can be raised by a heat source of not so high output. Therefore the prevention of over heating on the outer surface as well as the design of a heat source of rather low output which heat source is used to carry the method of this invention into practice can be attained even when the low-carbon stainless material is thick. Consequently it is possible not only to prevent the coarsening and melt-caused damage on the outer surface of the material but also to plan to reduce the cost of the equipment used to carry the method of this invention into practice.

(7) In consideration of the fact that, as can be seen from the examples by the above-stated test pieces, the residual tensile stresses which had been produced on the inner side-wall of a butt-welded pipe as a result of two butted pipes being welded from outside into the pipe were caused to disappear by heating the weld according to the method of this invention to a temperature at which carbide would enter into solid solution, whereas at the portions where the tensile stresses had been previously present, residual compressive stresses were produced by rapidly quenching said pipe by allowing water flow into said pipe after said heating according to the method of this invention, the portions (surfaces and sides) which may cause troubles if residual tensile stresses should be present should be cooled in such a way that cooling water comes in touch with the surfaces and sides of these portions.

In a case where the article to be treated is a pipe, a cooling liquid nozzle 6 for supplying cooling-liquid is generally provided in the pipe as shown in FIGS. 2, 11 or 12, in order to prevent the production of residual tensile stresses on the inner side wall of the pipe, but in such a case where it is practically impossible to insert the cooling liquid nozzle 6 and an open-close valve thereof 6V into the pipe in the neighborhood of the portion to be treated as a case where said portion to be treated lies in the middle of a long bent pipe, a valve-ball 8 which is filled with gas so that close contact can be made between the valve-ball 8 and the inner side wall of the pipe and flow-rectifying ball 9 which forms a clearance with the inner wall of the pipe are inserted into the pipe in the neighborhood of the portion to be treated as shown in FIG. 13, the pipe is filled with water this side of the valve-ball 8, and at the time of cooling after heating, the gas is allowed to out of the valve-ball 8 by opening an open-close calve of the valve-ball 8 in order that the water can be spouted from the clearance between the valve 8 and the innter wall of the pipe as shown in FIG. 14. Thereby, the provision of a means of cooling and the rapid supply of cooling liquid becomes possible and a rapid cooling can be achieved, irrespective of position of the portion to be treated.

As have been stated, since the method of this invention permits the disappearance of only the sensitized structure of stainless material which structure has been formed by a thermal effect during heating-work or working accompanied by a rise in temperature at the time of assembling the stainless material into a part of or incorporating the stainless material into the main body while subjecting the stainless material to local heating or working accompanied by a rise in temperature in a factory or job site in building such an equipment or plant as a nuclear reactor equipment or chemical plant which is to be put under severe corrosive environment without the formation of new sensitized structure at the other portion of sound structure, the method of this invention is capable of subjecting only the portions of which the structure has been sensitized to solutiontreatment, of course, when said stainless material is an independent part or even when said stainless material has been incorporated into the main body. Therefore the method of this invention is an industrially extremely useful method which can solve existing problems.

What is claimed is:

1. A method for locally solution treating austenitic stainless material which has been partially sensitized, as by a local rise in temperature, without creating a sensitized structure at the thermal boundaries between the locally treated portion and the remainder of the material, comprising the steps of:

(a) rapidly heating the sensitized portions of the material to a temperature at which carbide will enter into solid solution; and (b) rapidly quenching the heated material.

2. The method of claim 1 wherein the total treating time is determined as a function of the carbon content of the stainless material.

3. The method of claim 1 wherein the rapid heating of the stainless material is by induction heating.

4. The method of claim 1 wherein the quenching of the stainless material is by contact of at least one surface thereof with water.

5. The method of claim 1 including the step of heat treating the stainless material to improve the structure of the material prior to steps (a) and (b).

6. A method of locally solution treating austenitic stainless material previously sensitized by heating without creating a sensitized structure at the thermal boundaries between the locally treated portion and the remainder of the material, comprising the steps of:

(a) induction heating the stainless material to a temperature at which carbon will enter into solid solution;

(b) rapidly quenching the heated material by the application of a cooling liquid to one surface thereof; and, (c) the total time period of the treatment being variable as a function of the carbon content of the stainless material.

* * * * *